US009228797B2

(12) United States Patent
Anderson et al.

(10) Patent No.: US 9,228,797 B2
(45) Date of Patent: Jan. 5, 2016

(54) FIREARM HANDGRIP WITH TOOL COMPONENT

(71) Applicants: Mark I Anderson, St. George, UT (US); Vince S. Warner, Alpine, UT (US)

(72) Inventors: Mark I Anderson, St. George, UT (US); Vince S. Warner, Alpine, UT (US)

( * ) Notice: Subject to any disclaimer, the term of this patent is extended or adjusted under 35 U.S.C. 154(b) by 0 days.

(21) Appl. No.: 14/534,873

(22) Filed: Nov. 6, 2014

(65) Prior Publication Data

US 2015/0121737 A1 May 7, 2015

Related U.S. Application Data

(60) Provisional application No. 61/900,520, filed on Nov. 6, 2013.

(51) Int. Cl.
*F41C 23/16* (2006.01)
*F41B 15/08* (2006.01)
*F41C 23/22* (2006.01)

(52) U.S. Cl.
CPC ..... *F41C 23/16* (2013.01); *F41B 15/08* (2013.01); *F41C 23/22* (2013.01)

(58) Field of Classification Search
CPC ..... F41C 23/26; F41C 23/22; F41B 15/08
USPC ..... 42/72, 53; 89/1.42
See application file for complete search history.

(56) References Cited

U.S. PATENT DOCUMENTS

| | | | | |
|---|---|---|---|---|
| 2,805,507 | A * | 9/1957 | Buquor | 42/53 |
| 7,243,454 | B1 * | 7/2007 | Cahill | 42/72 |
| 8,984,789 | B2 * | 3/2015 | Adcock, Jr. | 42/72 |
| 2014/0338245 | A1 * | 11/2014 | Lanasa et al. | 42/72 |

* cited by examiner

*Primary Examiner* — Reginald Tillman, Jr.
(74) *Attorney, Agent, or Firm* — Geoffrey E. Dobbin; Dobbin IP Law P.C.

(57) ABSTRACT

A handgrip for a firearm is disclosed. The handgrip features a tool, in particular a melee component, stowed within a portion of the handgrip, the remaining portion of the melee component forming a finger guard. A latch is provided to hold the melee component in the stowed position. The interface of the melee component with the handgrip component may be either a rotatable interface, utilizing a lower pivot point and a latch such that the melee component may be rotated out of the handgrip or may be a sliding interface, with the melee component sliding within a provided trench. Two latching mechanisms for a rotating interface are disclosed. Other tools, such as bipods and flashlights, may be adapted to also fit the provided trench.

14 Claims, 10 Drawing Sheets

FIREARM HANDGRIP WITH TOOL COMPONENT

CROSS-REFERENCES TO RELATED APPLICATIONS

This application claims priority on prior filed U.S. Application No. 61/900,520, filed Nov. 6, 2013 and incorporates the same by reference in its entirety.

FIELD OF THE INVENTION

The present invention relates to the field of firearms and more particularly relates to a handgrip for a long personal firearm which further contains a removable melee component.

BACKGROUND OF THE INVENTION

The use of firearms is ubiquitous. Firearms are used in recreational, military and personal security scenarios. One of the most common firearms is a long arm, usually in the form of a personal rifle, shot gun or similar firearm used by an individual and having an extended barrel. These firearms are usually, though not always, held by the user in a manner that braces the butt stock of the firearm against the user's shoulder (dominant hand) while the hand of the opposite shoulder is used to support the barrel. One old invention to aid in the non-dominant hand's support of the barrel is the fore grip. The fore grip is a handle that is attached to the barrel or other forward structure of the firearm whereby the user grasps the handle in an effort to support the firearm. Placement of the fore grip is usually (not always) distal in relation to the barrel and rearward of the barrel's borehole, or muzzle. Use of a fore grip, then, not only aids in support of the barrel, but also helps keep the user's hand away from the muzzle of the firearm. Both of these aspects contribute greatly to the overall safer use of the firearm.

One other auxiliary function of the fore grip, and other handgrips provided a firearm, is storage. As the handgrip is, essentially, a conveniently placed mass or structure occupying a given volume. Utilizing that volume efficiently is a concern among the industry. Handgrips have, therefore, been used for some time to store useful articles, such as spare batteries and tools.

While the firearm can be in and of itself an impressive and effective weapon, there are three inherent limitations to a firearm. The first is obvious—there is usually a limited supply if ammunition. Once ammunition is expended, the long firearm is then relegated to being an over-engineered club or, if a bayonet is utilized, a thrusting spear. The second limitation is that, being a mechanical system, the weapon can fail—in which case the end result is similar to running out of ammunition. The third limitation is the presence of an ineffective range immediately about the user. An opponent can, in theory, get too close to the user for effective use of the firearm. Specialized training in close-quarters combat situations mitigates this limitation by training the user to effectively use the weapon at very short ranges, but the limitation is still present. To this end, those using firearms professionally tend to have back-up weapons, usually a side arm or melee weapon. These weapons are easily deployed when the primary long firearm is no longer useful and, while they have shorter effective ranges, they also tend to have shorter ineffective ranges.

In extremely close quarters, such as situations involving crowd control, control of a weapon is of paramount concern. The last thing any law enforcement officer desires is for a crowd participant with less than peaceful motivation to suddenly wrest a weapon from the officer. A handgrip aids in maintaining control of the weapon in such circumstances. A handgrip with more positive user interaction furthers this aim more than those that have less positive user interaction. More positive user interaction also inherently increases control of the weapon while using it or while moving.

The present invention is a handgrip, in its preferred embodiment a fore grip, for a long firearm that contains an easily deployed tool, such as a melee weapon. The tool is stored within and becomes a component of the handgrip. In the event it is needed, the tool is easily deployed and, in the case of a melee weapon used as a force multiplier in the event of melee combat.

The present invention represents a departure from the prior art in that the fore grip of the present invention allows for convenient storage and access to a back-up melee weapon.

SUMMARY OF THE INVENTION

In view of the foregoing disadvantages inherent in the known types of fore grips and firearms, this invention provides a tool in the form of a back-up melee weapon that is easily stowed in the fore grip of the firearm. As such, the present invention's general purpose is to provide a new and improved handgrip that is easily installed on the weapon, is rugged such that it could be used as a weapon, and contains a readily accessible, removable, tool such as a melee weapon component.

To accomplish these objectives, the preferred embodiment of the handgrip is a fore grip comprising a main grip body with a forward slot. The slot contains a lower pivot mount and an upper latch mechanism. A melee component of a type commonly known as "brass knuckles" is insertable in the slot and rests on the pivot mount. The melee component is held in place by the upper latch mechanism. When deployment is desired, the upper latch mechanism is released and the melee component may be pivoted out of the slot, in ready position for use. When not in use, the melee component provides a finger guard for the handgrip and also provides additional gripping capacity. The handgrip of the present invention also provides an easy attachment interface for other useful items and tools, like a bi-pod, knife, or flashlight, by removing the melee component and replacing it with a tool made or fitted with an appropriate interface.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
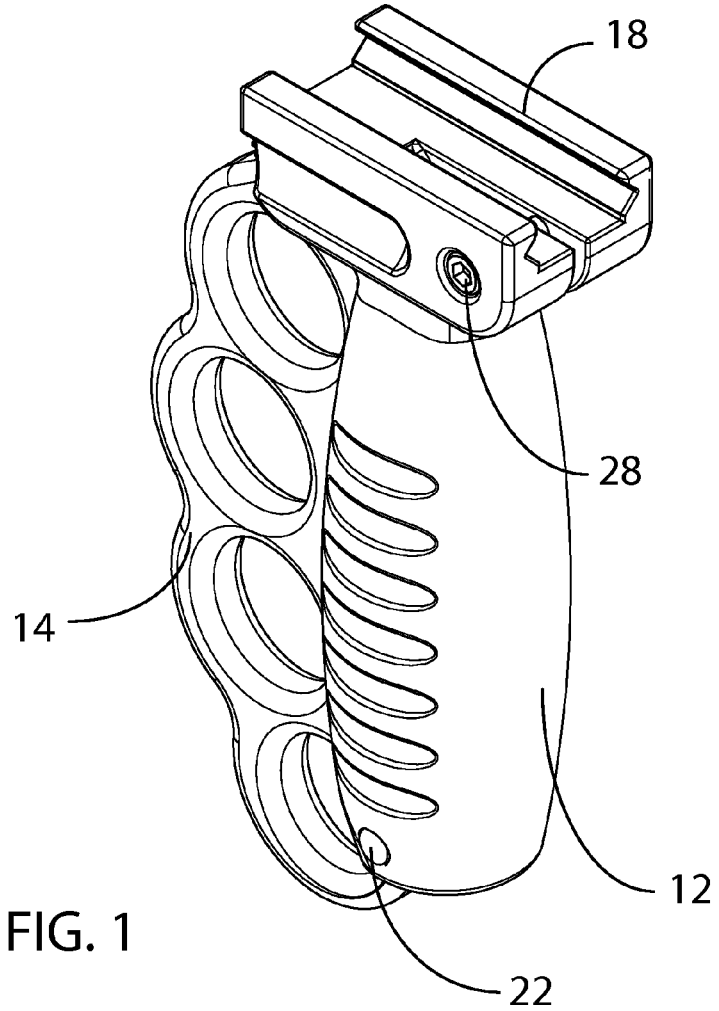
FIG. 1 is a perspective view of a preferred embodiment of the handgrip.
Figure 2:
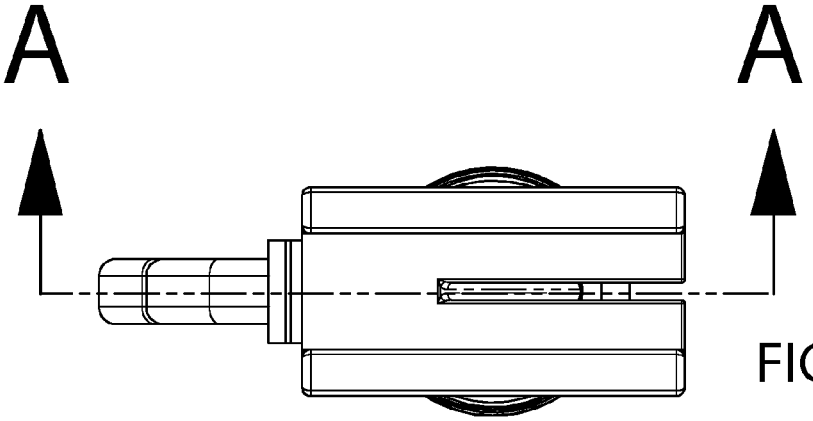
FIG. 2 is a top plan view of the handgrip of FIG. 1.
Figure 3:
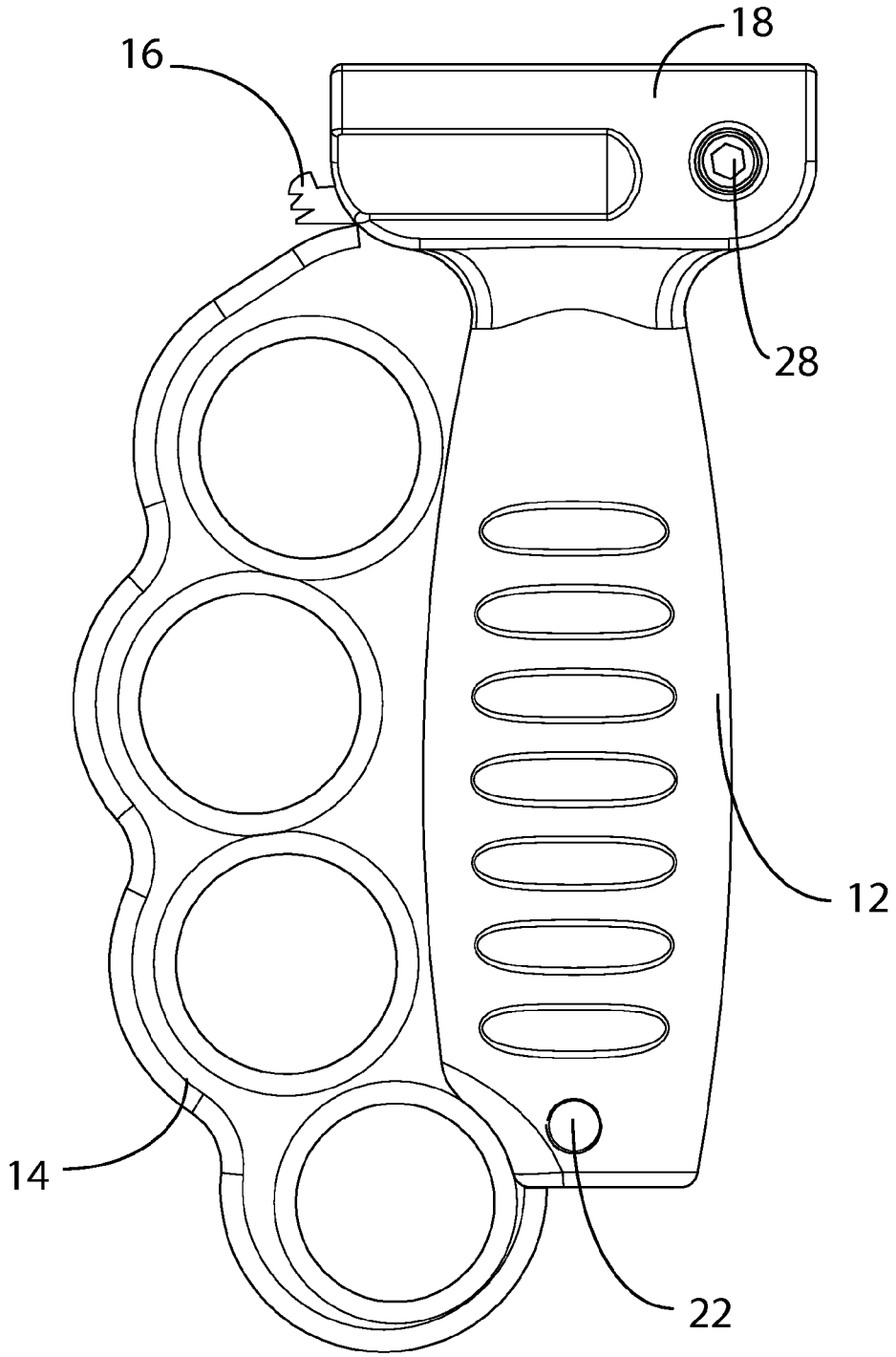
FIG. 3 is a side elevation view of the handgrip of FIG. 1.
Figure 4:
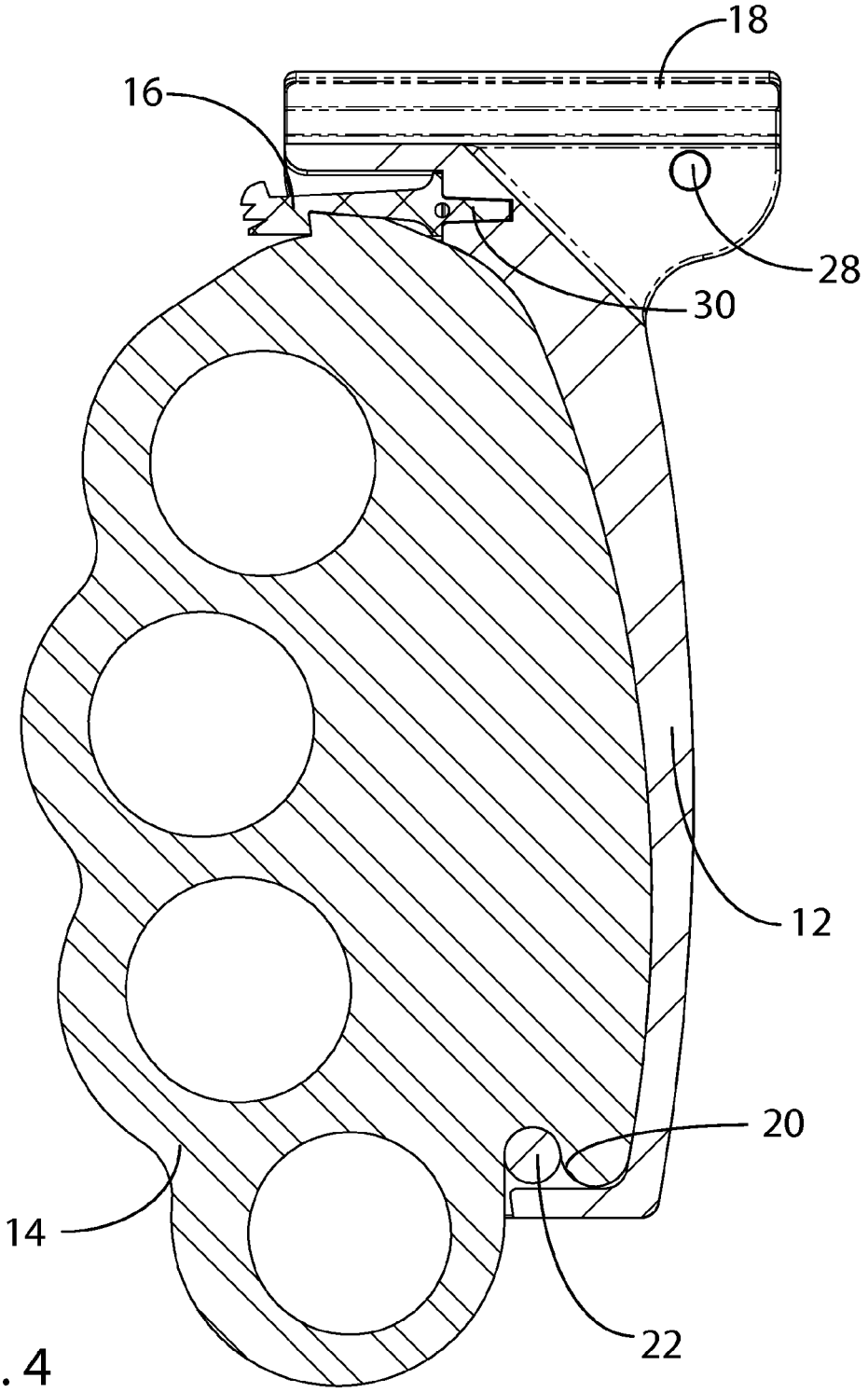
FIG. 4 is a sectional view of the handgrip of FIG. 2, taken along line A-A.
Figure 5:
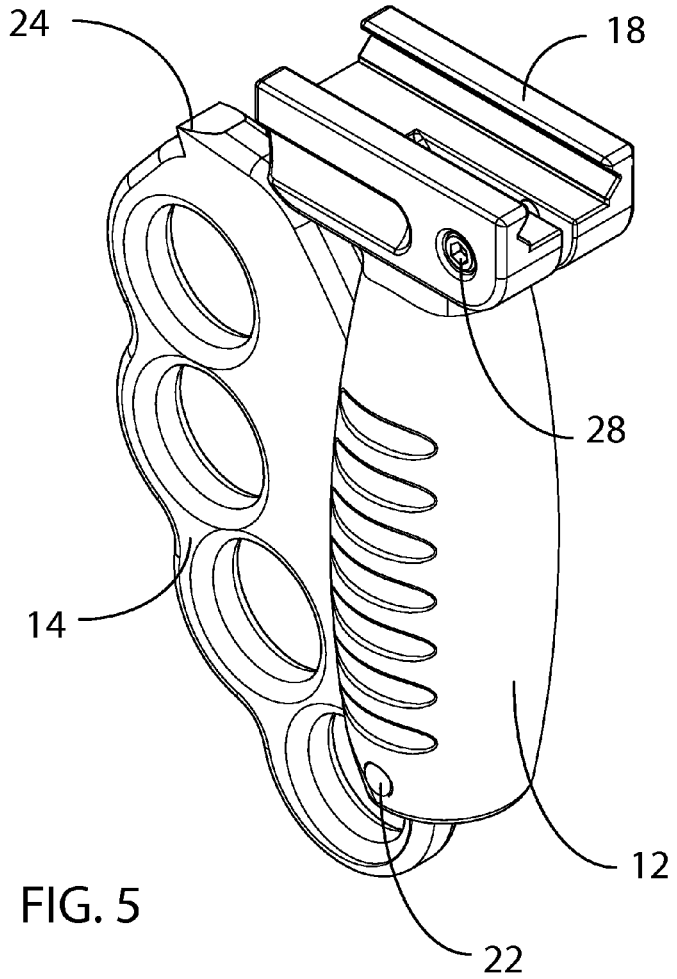
FIG. 5 is a perspective view of a preferred embodiment of the handgrip, the melee component being partially removed.
Figure 6:
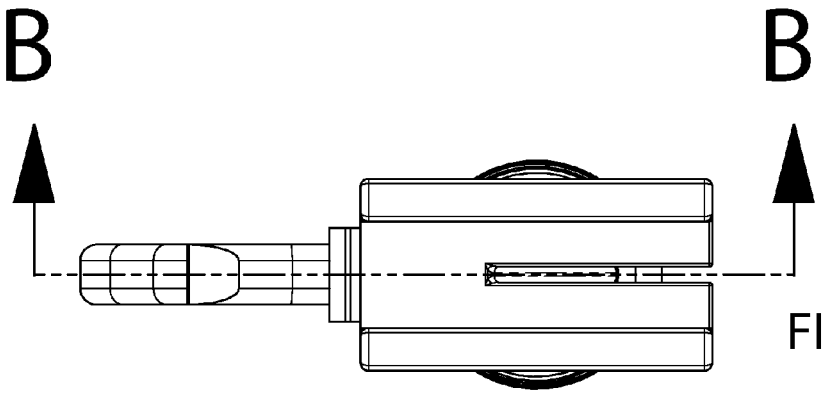
FIG. 6 is a top plan view of the handgrip of FIG. 5.
Figure 7:
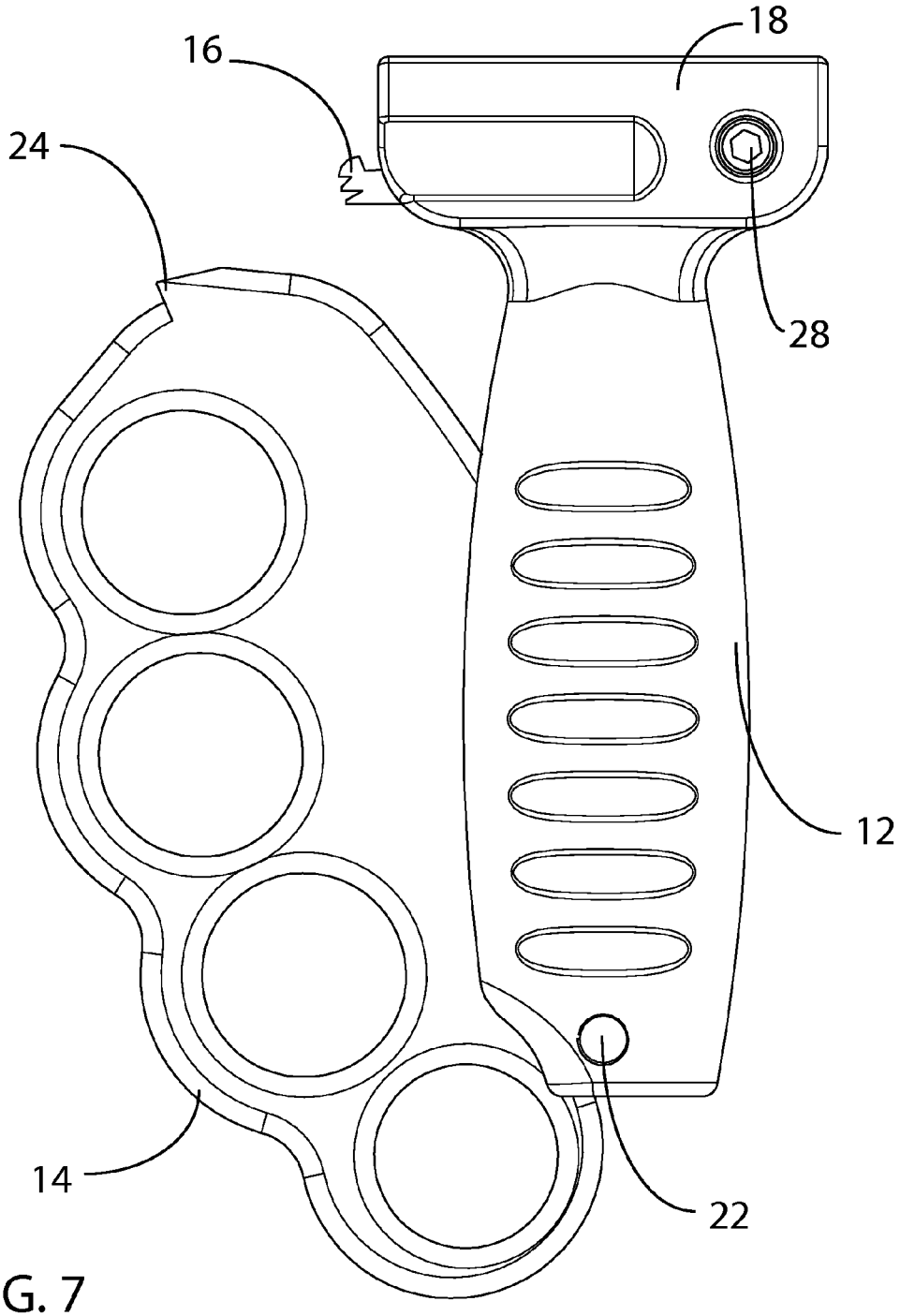
FIG. 7 is a side elevation view of the handgrip of FIG. 5.

With reference now to the drawings, the preferred embodiment of the handgrip is herein described. It should be noted that the articles "a", "an", and "the", as used in this specification, include plural referents unless the content clearly dictates otherwise.

With reference to FIGS. 1-4, the handgrip comprises a grip body 12 with a tool, such as melee component 14, embedded within. The preferred handgrip is a fore grip, as illustrated, but other grip designs and locations are possible and should be considered as within the purview of the invention. A mounting structure, such as the rail attachment 18, is provided in which to attach the handgrip to a firearm. Any mounting structure known in the art or later developed may be utilized to attach the handgrip to the firearm, such as simple metal straps wrapped around a barrel, as with the first handgrips of about 150 years ago, to the rail system depicted in the drawings here. In the case of the rail attachment of the preferred embodiment, the attaching body is formed of two portions that are partially laterally separated and further connected by tightening bolt 28. The handgrip is positioned on a rail positioned on the firearm, usually in a distal location to the barrel, though a lateral or other location are possible, and the bolt 28 tightened, locking the handgrip into position.

Figure 8:
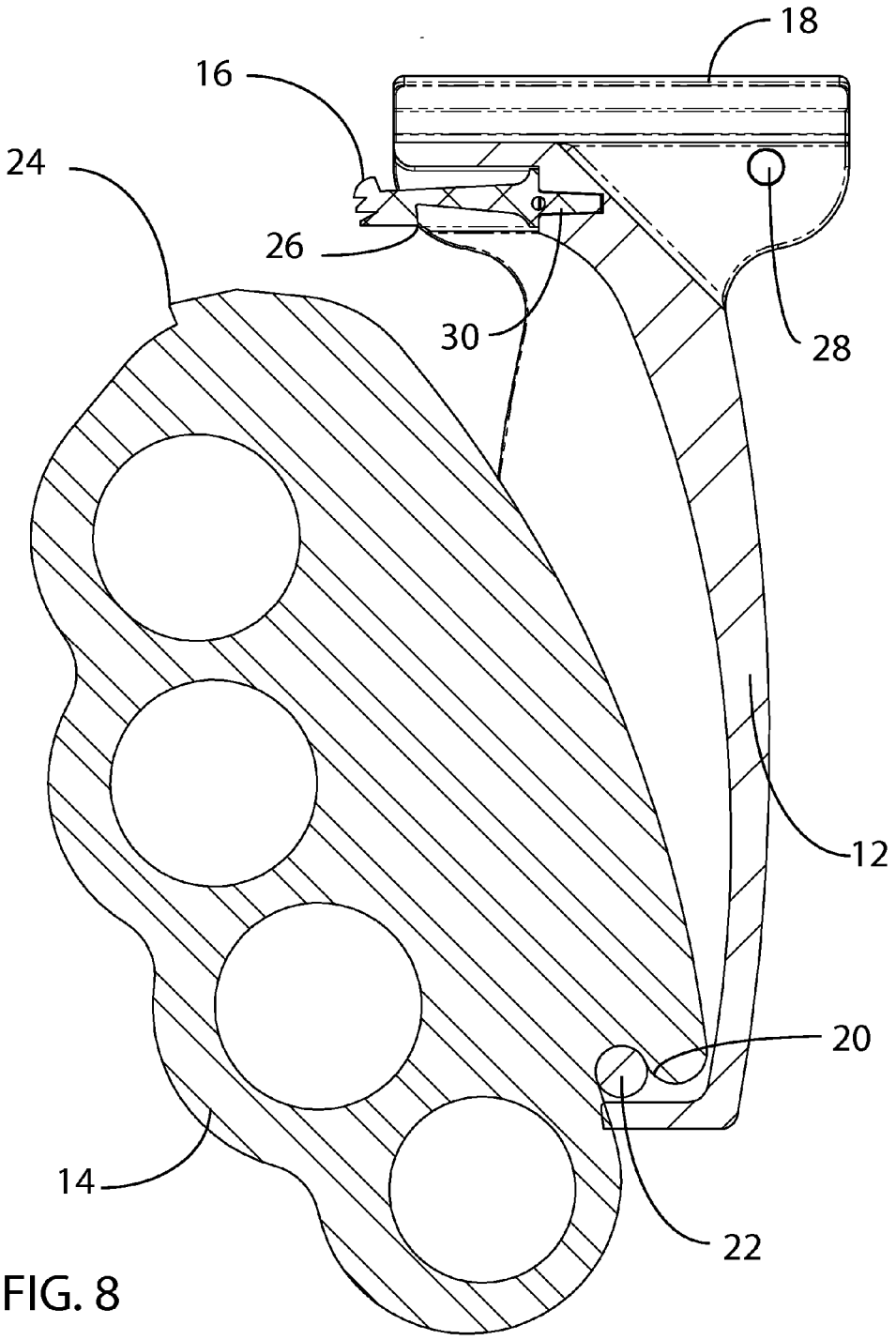
FIG. 8 is a sectional view of the handgrip of FIG. 6, taken along line B-B.
Figure 9:
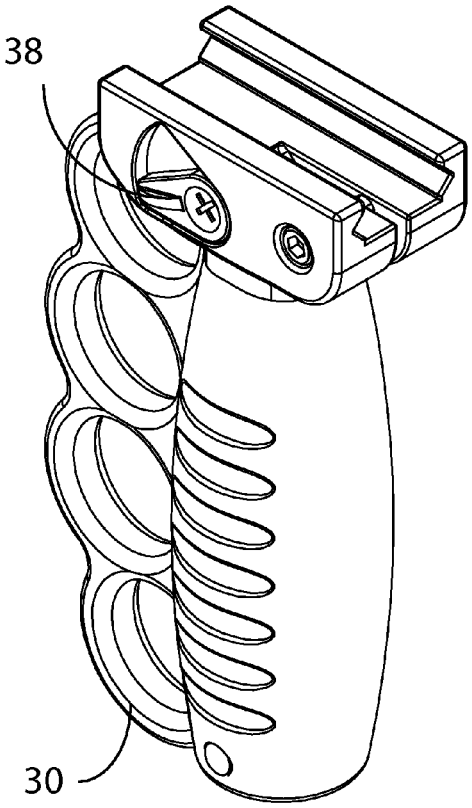
FIG. 9 is a perspective view of another preferred embodiment of the handgrip.
Figure 10:
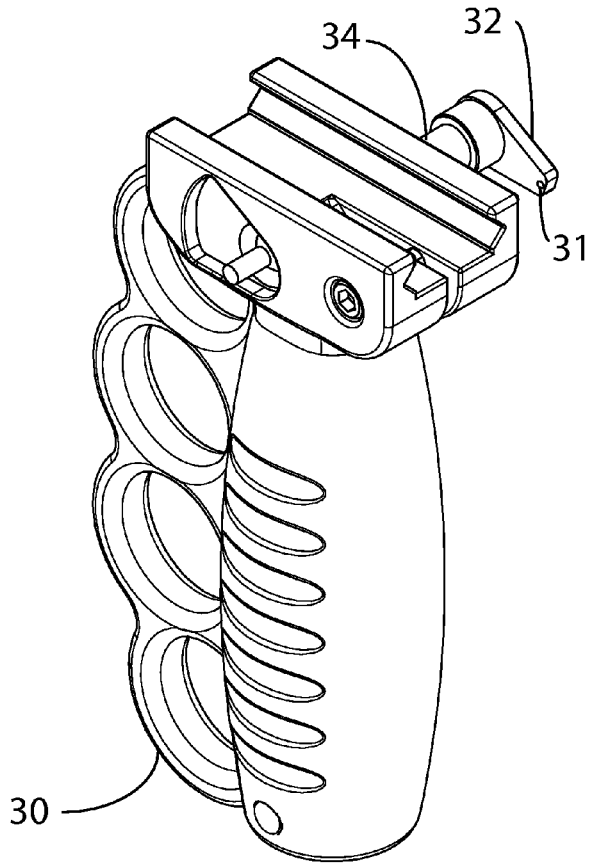
FIG. 10 is a perspective view of the handgrip of FIG. 9, the latching mechanism being partially disassembled.
Figure 11:
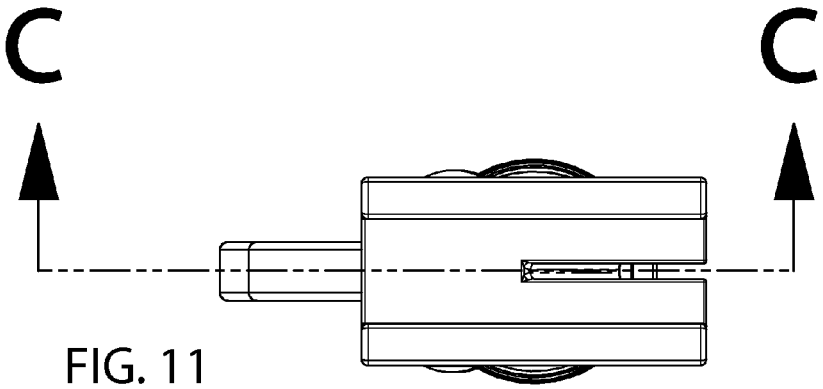
FIG. 11 is a top plan view of the handgrip of FIG. 9, with the latching mechanism locked.
Figure 12:
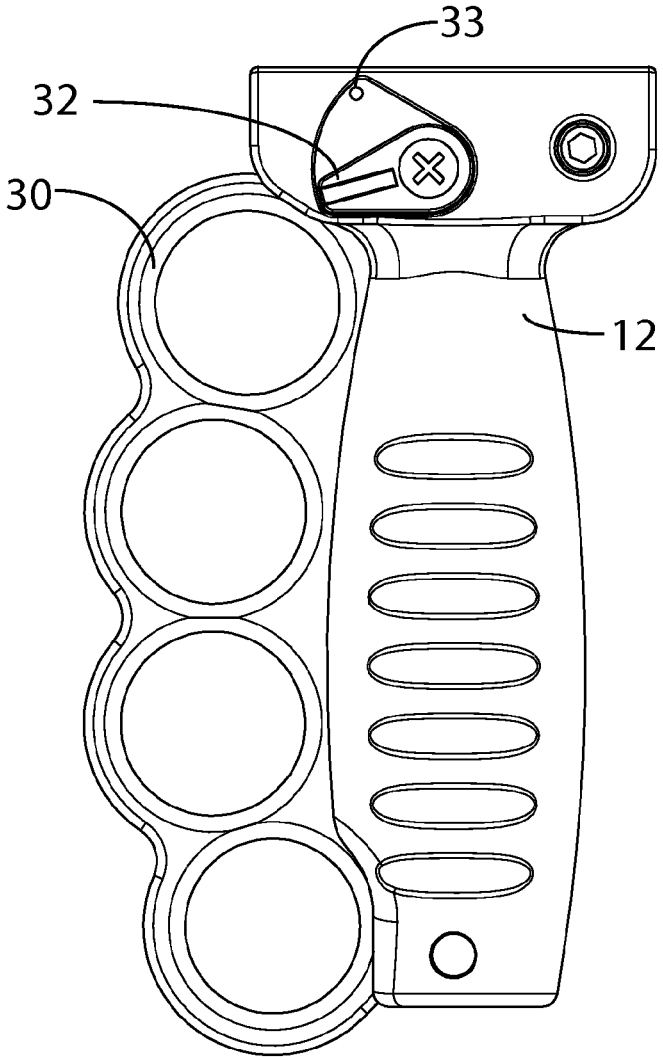
FIG. 12 is a side elevation view of the handgrip of FIG. 9, with the latching mechanism open.
Figure 14:
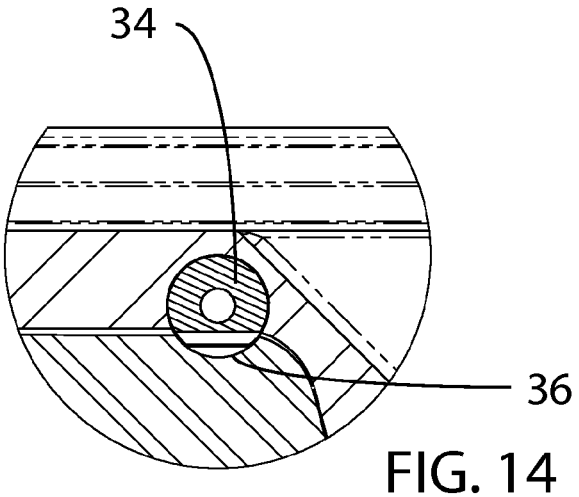
FIG. 14 is a close up view of the handgrip of FIG. 13, taken in circle D, but with the latching mechanism open.

The melee component 14 is held in the handgrip body 12 by the interaction of two contacts. The first contact is a lower pivot point 22. The melee component features a rounded notch 20, with which it interfaces the lower pivot point 22. The upper contact point is a latch 16. The depicted latch 16 is a flexible post embedded in the handgrip body 12 by a post anchor 30. The latch's location is depicted directly above the melee component 14, in line with a plane defined by the melee component 14. The depicted latch features a distal tooth 26 that interfaces with a dorsal tooth 24 in the melee component 14 (FIG. 8). However, other latching mechanisms, such as a spring loaded plunger that is located to the side of the melee component 14, is also possible. The lower pivot point 22 and notch 20 are both rounded so as to allow the melee component 14 to rotate outward when released.

Release of the melee component 14 is depicted in FIGS. 5-8. Once the latch 16 is released, the melee component 14 is free to rotate downwards, about the pivot point 22. As the user's fingers should already be located in the provided finger holes, the melee component 14 is easily readied for action as the user merely closes his first about the component 14. Ideally, the back of the melee component should be rounded to aid in force distribution on the user's hand when the component is actually utilized. However, any design which may be appropriately stowed in the grip body 12 and released therefrom may be utilized. The melee component 14 may easily be returned to its stowage position by hooking the notch 20 onto the lower pivot point 22 and rotating the melee component back into position such that the latch 16 re-engages the melee component 14.

Alternate interfaces of the handgrip body 12 and melee component 14 are also possible. One alternate construction involves a lower or upper latch mechanism. In this alternate embodiment, the melee component 14 slides into a trench in the handgrip body 12 and then engages the latch mechanism. Upon release, the melee component 14 merely slides down the trench until free from the handgrip body 12.

Figure 13:
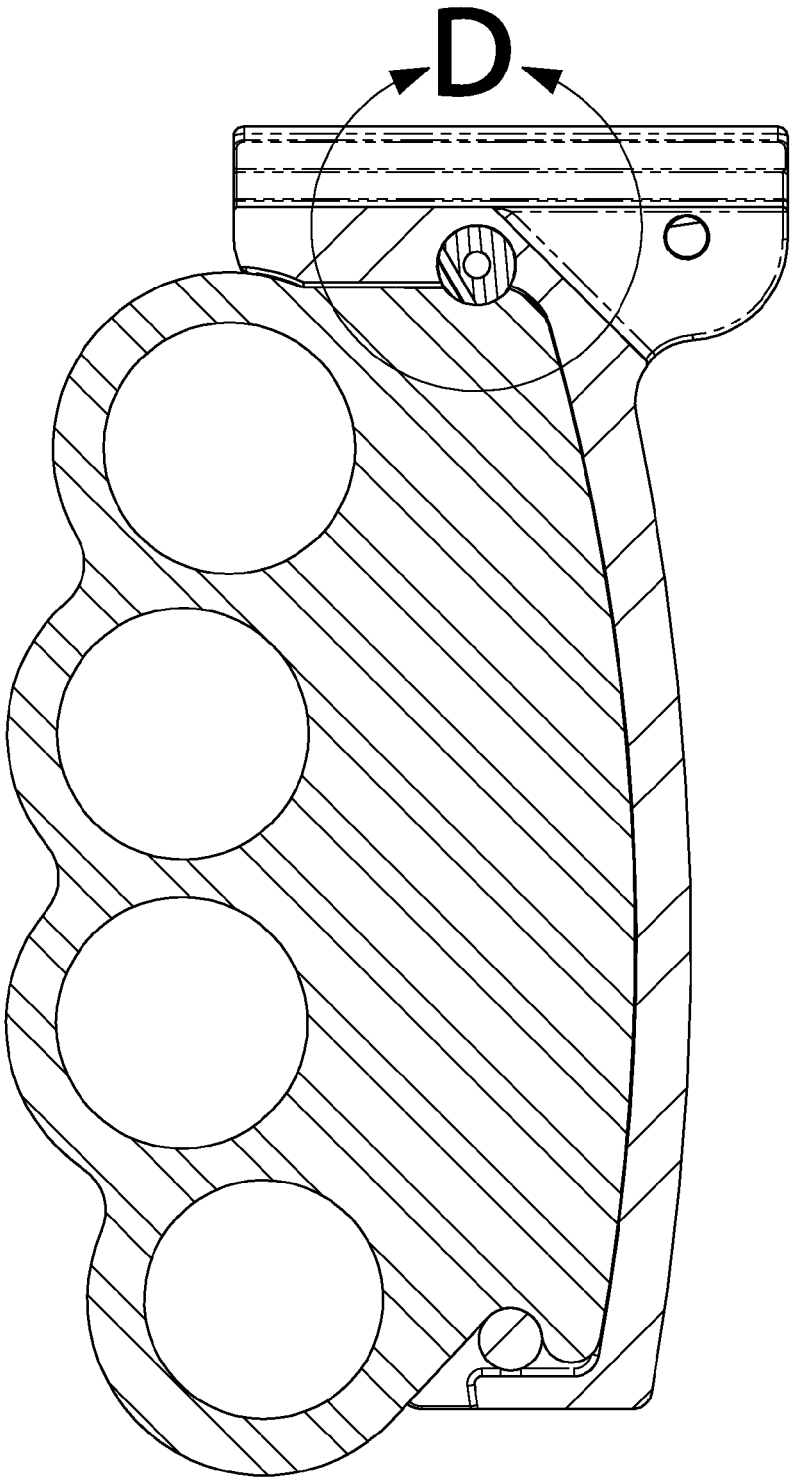
FIG. 13 is a sectional view of the handgrip of FIG. 11, taken along line C-C.
Figure 15:
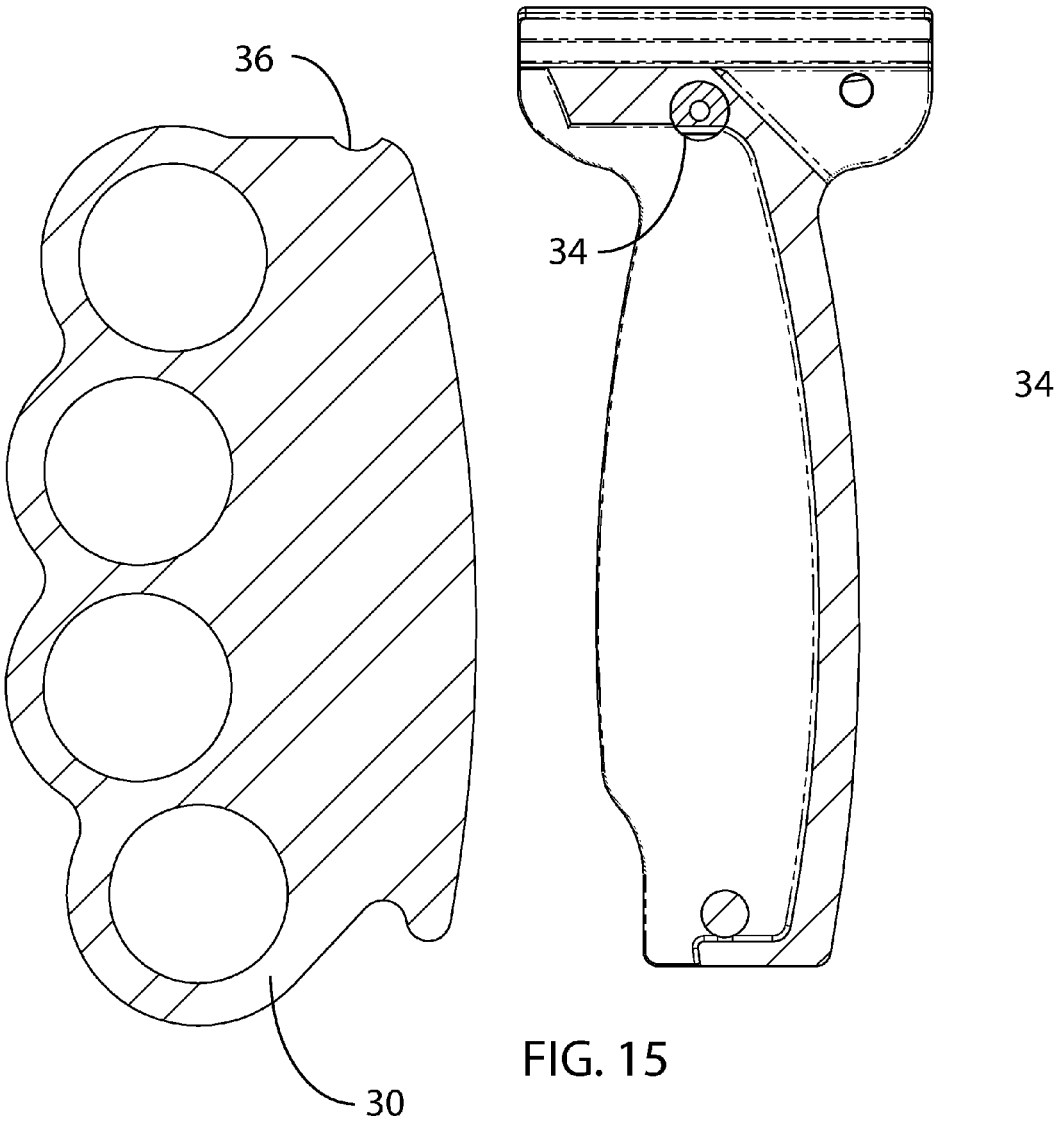
FIG. 15 is a sectional view of the handgrip of FIG. 9, with latch open and the melee component removed.

Another preferred embodiment utilizes a rotatable latching mechanism. FIGS. 9-15 depict a handgrip with a thumb rotatable cam latch 38. Cam latch 38 features dual thumb tabs 32 connected on either side of a cam cylinder 34. When interfacing the melee component, the cam cylinder resides in a divot 36 positioned in the upper edge of the melee component 30. Slight rotation of the cam latch 38 positions a gap in the cylinder 32 about the divot 36, releasing the melee component 30. The depicted cam latch mechanism 38 has the thumb tabs 32 directed towards the front of the handgrip, nested within a cutout that allows a rotation through an arc of about 60°, approximately 30° above and below horizontal as defined by the handgrip. This allows the thumb tabs 32 to be in either an upper or a lower position. In this embodiment, the upper position is set as locked. In this position, as is shown in FIG. 13, the cam cylinder 34 is rotated in a manner that the gap, in this case a notch cut or otherwise formed into the cam cylinder 34 and positioned in line with a plane defined by the melee component 30, does not interact with the divot 36. A bump 31 and dimple 33 (FIGS. 10 and 12) formed in the thumb tabs 34 and grip body 12 provide a locking mechanism that keeps the thumb tab 32 in this upper position until it is desired to open the system. In the lower position (FIGS. 9, 12 and 14), the cam cylinder 34 is rotated such that the divot 36 interfaces with the notch, freeing the melee component 30 (FIG. 15).

It should be readily understood that other tools and accessories are easily mounted upon the handgrip as described in either of these embodiments once they are made with an interface as described in the above embodiments. Likewise, a fitting may be manufactured to adapt tools such as flashlights, knives, and bi-pods to interface with the handgrip. Mere description of the embodiments with a "melee component" should not be seen as limiting the application of the invention to other useful objects, accessories or, as they are all broadly described, tools.

Construction of the handgrip body 12 may be of any suitable material. Metals and polymers are preferred. The melee component 14 may also be of any suitable, hard, material. Metals and polymers may be used, as may other materials such as wood. The material of the melee component 14 does not have to be the same as the handgrip body 12. The handgrip may be manufactured in a manner such that the melee component is not present, and a four-holed finger guard is in its place. While missing the utility of the full invention, the grip and handling advantages of the invention would still be maintained.

Although the present invention has been described with reference to preferred embodiments, numerous modifications and variations can be made and still the result will come within the scope of the invention. No limitation with respect to the specific embodiments disclosed herein is intended or should be inferred. The presently described components of the preferred embodiment may be described in a particular orientation or having particular co-acting features formed on particular components; but, it should be readily understood that various orientations and that shifting co-acting features to other suitable components are all possible and still within the purview of this invention.

What is claimed is:

1. A handgrip for a firearm, the handgrip comprising:

a. a grip body, said grip body further comprising a trench;

b. a means for attaching the grip to the firearm;

c. a melee component, slidable within the trench;

d. a latch mechanism interfacing the grip body and the melee component, the latch mechanism further comprising:

i. a flexible post, located along an upper edge of the melee component, the flexible post having a distal tooth;

ii. a dorsal tooth on the melee component, the distal and dorsal teeth engaged when the melee component is in a stowed position within the handgrip and the flexible post having enough flexibility to disengage the distal and dorsal teeth so as to free the melee component; and e. a pivot opposite the latch mechanism, upon which the melee weapon rotates as it is positioned inside the grip and removed therefrom.

2. The handgrip of claim 1, the melee component being of the type commonly known as "brass knuckles".

3. A handgrip for a firearm, the handgrip comprising:

a. a grip body, said grip body further comprising a slot b. a means for attaching the grip to the firearm;

c. a tool, slidable within the trench;

d. a latch mechanism interfacing the grip body and the tool the latch mechanism further comprising;

i. a divot in an upper edge of the tool;

ii. a mostly cylindrical cam, said cam having a notch positioned along one arcuate portion of the cylindrical cam and in alignment with the upper edge of the tool; and iii. means for rotating the cylindrical cam such that in a locked position the cylindrical cam interacts with the divot and when in an open position the notch is positioned over the divot, freeing the tool for rotation about the lower pivot; and e. a pivot opposite the latch mechanism, upon which the tool rotates as it is positioned inside the grip and removed therefrom.

4. The handgrip of claim 3, the means for rotating the cylindrical cam being at least one thumb tab connected to the cylindrical cam.

5. The handgrip of claim 4, the latch mechanism further comprising a dimple and a bump, one formed in the at least one thumb tab, one formed in the grip body, that interface when the latch is in the locked position.

6. The handgrip of claim 3, the tool being a melee weapon.

7. The handgrip of claim 6, the melee component being of the type commonly known as "brass knuckles".

8. The handgrip of claim 4, the tool being a melee weapon.

9. The handgrip of claim 8, the melee component being of the type commonly known as "brass knuckles".

10. The handgrip of claim 5, the tool being a melee weapon.

11. The handgrip of claim 10, the melee component being of the type commonly known as "brass knuckles".

12. A handgrip for a firearm, the handgrip comprising:

a. a grip body, said grip body further comprising a slot b. a means for attaching the grip to the firearm;

c. a tool, slidable within the trench;

d. a latch mechanism interfacing the grip body and the tool the latch mechanism further comprising:

i. a flexible post, located along an upper edge of the tool, the flexible post having a distal tooth;

ii. a dorsal tooth on the melee component, the distal and dorsal teeth engaged when the melee component is in a stowed position within the handgrip and the flexible post having enough flexibility to disengage the distal and dorsal teeth so as to free the tool; and e. a pivot opposite the latch mechanism, upon which the tool rotates as it is positioned inside the grip and removed therefrom.

13. The handgrip of claim 12, the tool being a melee weapon.

14. The handgrip of claim 13, the melee component being of the type commonly known as "brass knuckles".

* * * * *